US010791782B2

(12) United States Patent
Nakamura et al.

(10) Patent No.: US 10,791,782 B2
(45) Date of Patent: Oct. 6, 2020

(54) FALSE EYELASHES

(71) Applicant: TAIKI CORP., LTD., Osaka-shi, Osaka (JP)

(72) Inventors: Koji Nakamura, Osaka (JP); Toshihiko Ohira, Osaka (JP)

(73) Assignee: TAIKI CORP., LTD., Osaka (JP)

( * ) Notice: Subject to any disclaimer, the term of this patent is extended or adjusted under 35 U.S.C. 154(b) by 638 days.

(21) Appl. No.: 15/301,342

(22) PCT Filed: Mar. 31, 2015

(86) PCT No.: PCT/JP2015/060201
§ 371 (c)(1),
(2) Date: Sep. 30, 2016

(87) PCT Pub. No.: WO2015/152270
PCT Pub. Date: Oct. 8, 2015

(65) Prior Publication Data

US 2017/0127743 A1 May 11, 2017

(30) Foreign Application Priority Data

Apr. 1, 2014 (JP) ..... 2014-075815

(51) Int. Cl.
*A41G 5/02* (2006.01)

(52) U.S. Cl.
CPC ..... *A41G 5/02* (2013.01)

(58) Field of Classification Search
CPC ..... A41G 3/0066; A41G 5/02
(Continued)

(56) References Cited

U.S. PATENT DOCUMENTS 3,561,458 A * 2/1971 Udes ..... A41G 5/02 132/53
2012/0055499 A1* 3/2012 Sanbonmatsu ..... A41G 5/02 132/201

FOREIGN PATENT DOCUMENTS

CN 103251159 A 8/2013
JP S5319265 B2 6/1978
(Continued)

OTHER PUBLICATIONS

A First Office Action issued by the State Intellectual Property Office of China dated Sep. 28, 2017 for Chinese counterpart application No. 201580018033.1.

(Continued)

*Primary Examiner* — Edward Moran
(74) *Attorney, Agent, or Firm* — Law Office of Katsuhiro Arai

(57) ABSTRACT

In an embodiment, false eyelashes contain an axial thread 10 and eyelash materials which include multiple top eyelash materials 21 and multiple bottom eyelash materials 22 positioned above and below the axial thread, respectively. The top and bottom eyelash materials each have a structure where one eyelash material is folded where folded-back parts A, B are adjacent to the axial thread; the top and bottom eyelash materials, each having a folded-back part, are placed in rows in the length direction of the axial thread, while being fixed vertically; the top and bottom eyelash materials are alternately placed from one end to the other end of the axial thread; the folded-back parts of the adjacent top and bottom eyelash material are fixed together; and each fixed folded-back part is fixed to the axial thread to form an ear part C, thereby fixing the folded-back part to the axial thread.

7 Claims, 5 Drawing Sheets

(58) Field of Classification Search
USPC ..... 132/53
See application file for complete search history.

(56) References Cited

FOREIGN PATENT DOCUMENTS

| | | | |
|---|---|---|---|
| JP | 2006183215 | A | 7/2006 |
| JP | 5618389 | B2 | 11/2014 |
| WO | 2012014891 | A1 | 2/2012 |

OTHER PUBLICATIONS

International Search Report (ISR) dated Jun. 30, 2015, issued for International application No. PCT/JP2015/060201.
Notification Concerning Transmittal of International Preliminary Report on Patentability (PCT/IB326) and Notification of Transmittal of Translation of the International Preliminary Report on Patentability (PCT/IB/338) dated Oct. 13, 2016, with International Preliminary Report on Patentability (PCT/IB/373) and Written Opinion of the International Searching Authority (PCT/ISA/237), for corresponding international application PCT/JP2015/060201.

* cited by examiner

[FIG. 1]
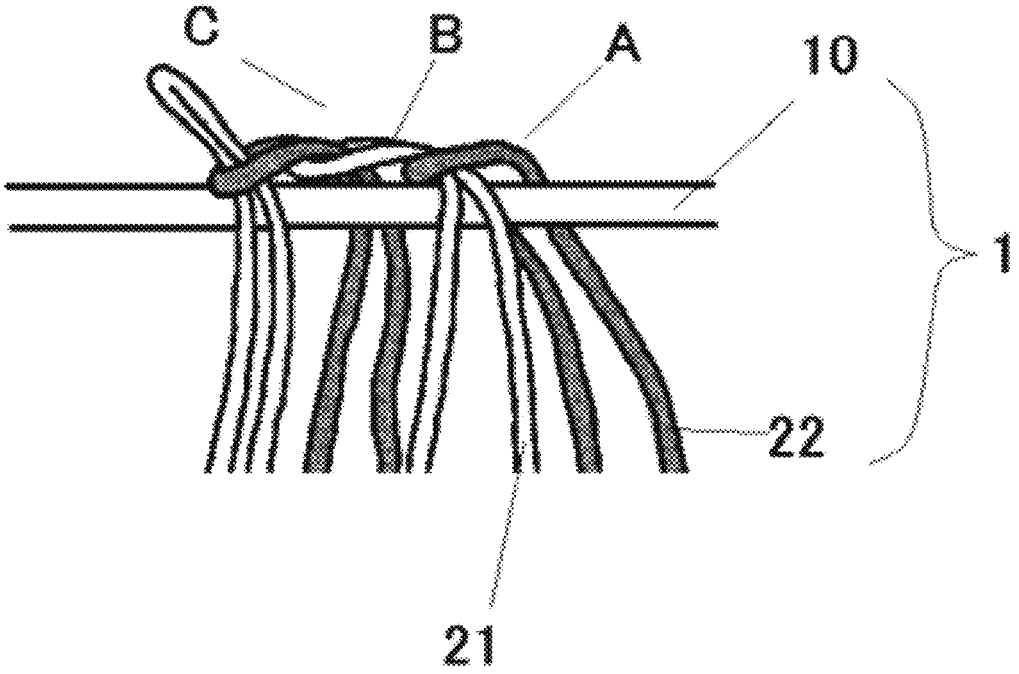

[FIG. 2]
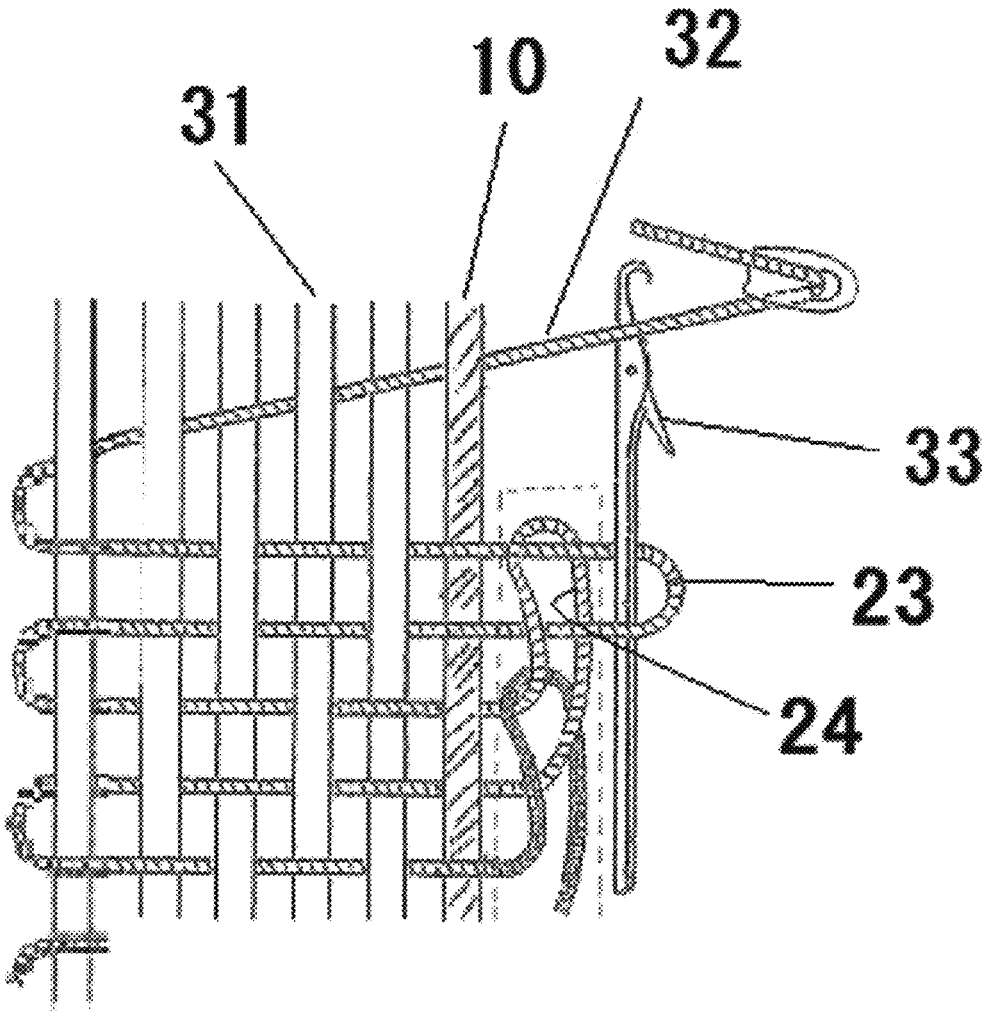

[FIG. 3]
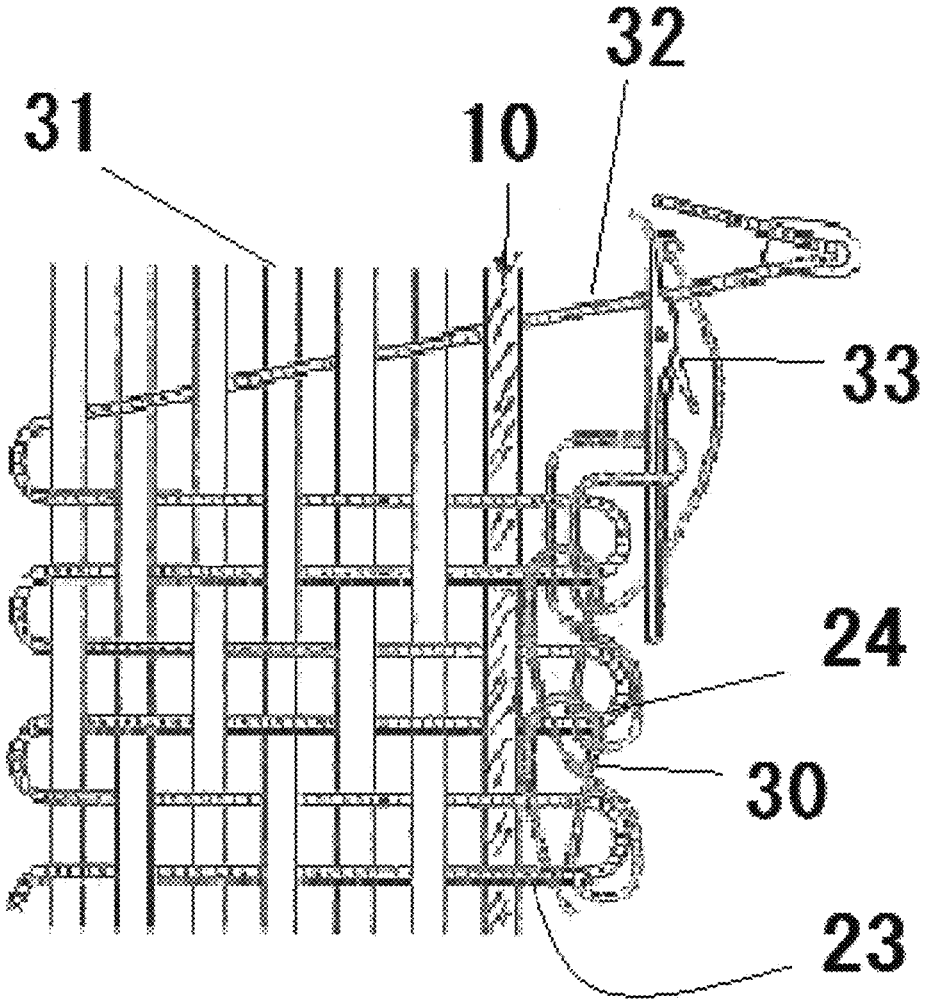

[FIG. 4]
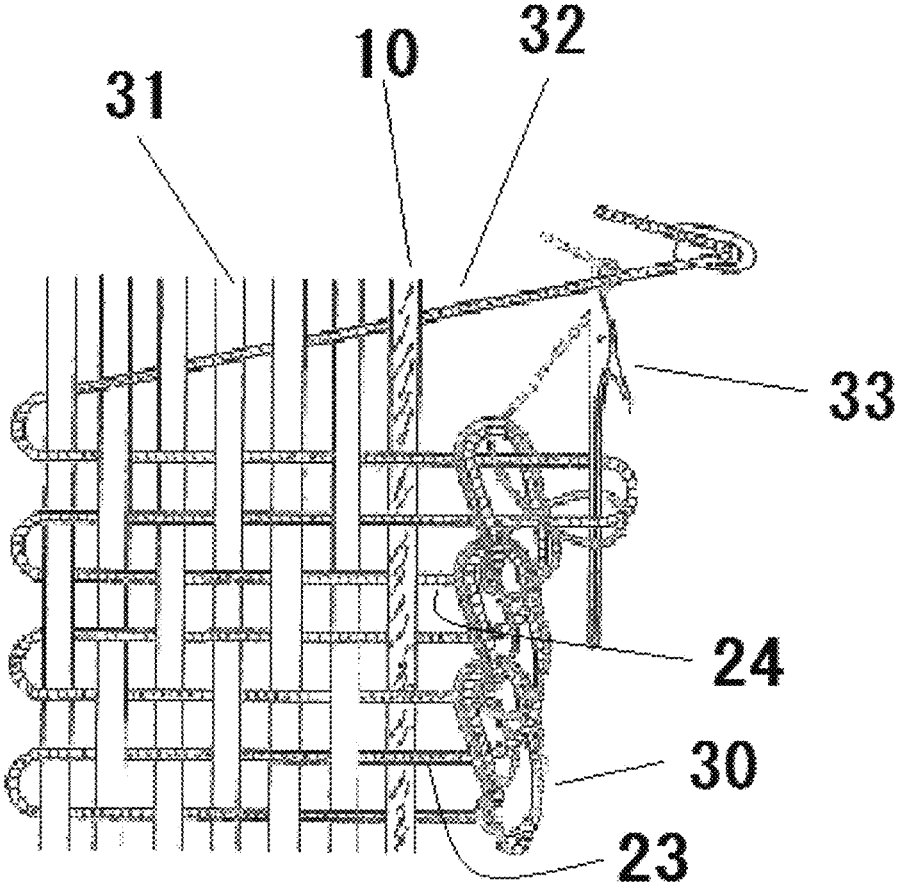

[FIG. 5]
Prior Art
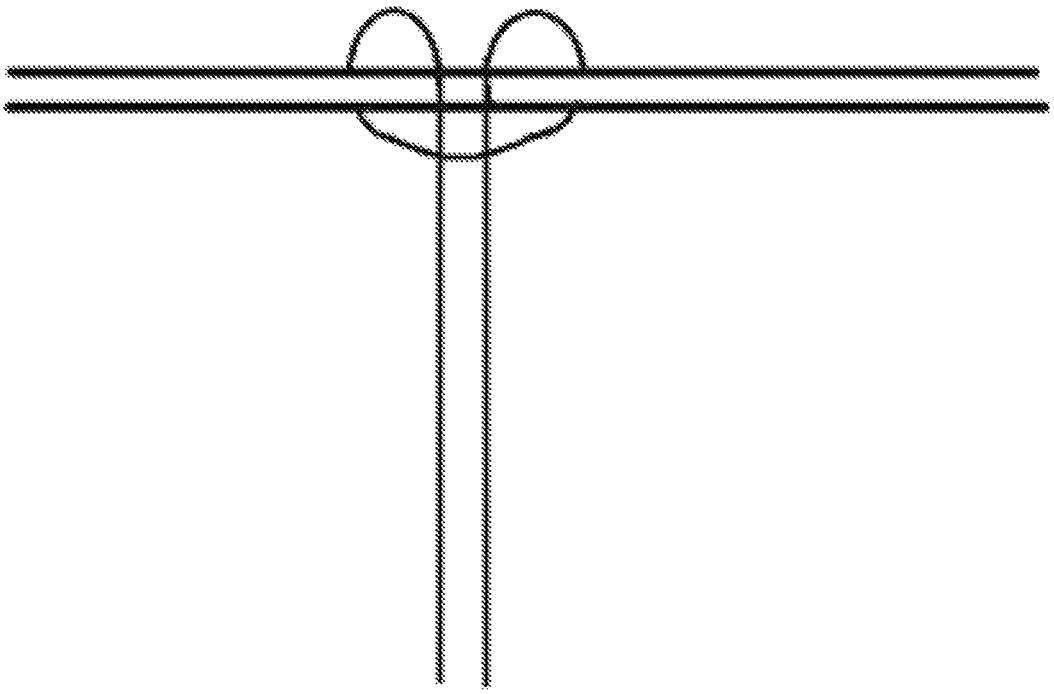

FALSE EYELASHES

This application is the U.S. National Phase under 35 U.S.C. § 371 of International Application PCT/JP2015/060201, filed Mar. 31, 2015, which claims priority to Japanese Patent Application No. 2014-075815, filed Apr. 1, 2014. The International Application was published under PCT Article 21(2) in a language other than English.

TECHNICAL FIELD

The present invention relates to a false eyelashes.

Background of the Invention

In recent years, false eyelashes have been a popular makeup technique among women to make their eyes look larger and prettier.

False eyelashes are traditionally manufactured by hand, with many long-fiber hair materials such as human hairs bound around an axial thread. Under a common binding method, as shown in FIG. 5, a long-fiber hair material is folded into two and the folded part is wrapped once around a core filament, after which both ends of the long fiber are guided through the loop formed at the folded part, and this way many hair materials are bound and their bound parts are fixed using adhesive, while their tips are cut, to manufacture a false eyelashes (Patent Literature 1).

The false eyelashes manufactured by the aforementioned method require expert skills to manually and evenly place very thin eyelash materials relative to the axial thread, and because placing them evenly is difficult, the eyelash materials cannot be bound evenly relative to the axial thread, resulting in an unattractive appearance characterized by sparse areas and dense areas, in which case the eyelashes do not look natural. Also, the inability to fix the eyelash materials evenly relative to the axial thread causes the so-called ear part to deform and consequently the eyelashes cannot be worn comfortably on the eyelid.

BACKGROUND ART LITERATURE

Patent Literature

Patent Literature 1: Japanese Examined Patent Laid-open No. Sho 53-19265

BRIEF SUMMARY OF THE INVENTION

False eyelashes are worn to make the eyes look larger and prettier, so desired eyelashes are those that are not only comfortable to wear, but that are also dimensionally stable and look natural with the eyelash materials placed evenly without creating sparse areas and dense areas.

Accordingly, the inventor of the present invention studied in earnest with an object of providing false eyelashes which have excellent dimensional stability, superior comfort when worn on the eyelid, and a natural look.

The present invention was developed to achieve the aforementioned object and is directed to false eyelashes containing an axial thread and eyelash materials placed on the axial thread, wherein the eyelash materials comprise multiple top eyelash materials positioned above the axial thread when the axial thread is placed horizontally, as well as multiple bottom eyelash materials positioned below the axial thread; the top eyelash materials and the bottom eyelash materials each have a structure where one eyelash material is folded. The folded-back part in this fold-back structure is adjacent to the axial thread and the multiple top eyelash materials and the multiple bottom eyelash materials, each having the folded-back part, are placed in rows in the length direction of the axial thread, while being fixed vertically so as to extend in the length direction of the axial thread. The top eyelash materials and the bottom eyelash materials are alternately placed from one end to the other end of the axial thread and the folded-back parts of the adjacent top eyelash material and bottom eyelash material are fixed together. The fixed folded-back part is fixed to the axial thread to form an ear part and as the ear part is formed, the folded-back part is fixed to the axial thread. Additionally, the folded-back part of the top eyelash material is fixed together with the folded-back part of the bottom eyelash material by means of a knit structure formed by the adjacent folded-back parts together. Alternatively the folded-back part of the top eyelash material is fixed together with the adjacent folded-back part of the bottom eyelash material by a lock thread. Alternatively the folded-back part of the top eyelash material is fixed together with the folded-back part of the bottom eyelash material by means of a knit structure formed by the adjacent folded-back parts and a lock thread. The axial thread, the top eyelash materials, and the bottom eyelash materials are made of a material selected from polyester fibers, polyamide fibers, polyolefin fibers, polyvinyl chloride fibers, natural fibers, and cellulose fibers. An antibacterial agent is blended into or applied onto any of the axial thread, the top eyelash materials, and the bottom eyelash materials. The axial thread is made of thermoplastic resin or any material other than the thermoplastic resin, at least partially.

According to the present invention, false eyelashes having excellent dimensional stability, superior comfort when worn on the eyelid, and a natural look, can be provided.

BRIEF DESCRIPTION OF THE DRAWINGS

FIG. 1 Overview drawing of the first embodiment

FIG. 2 Drawing showing an overview of the manufacturing method for the first embodiment FIG. 3 Drawing showing an overview of the manufacturing method for the second embodiment FIG. 4 Drawing showing an overview of the manufacturing method for the third embodiment FIG. 5 Overview drawing of a conventional false eyelash

DESCRIPTION OF THE SYMBOLS

1—False eyelashes
10—Axial thread
21—Top eyelash material
22—Bottom eyelash material
23—Loop of the weft filament providing the folded-back part of the top eyelash material
24—Loop of the weft filament providing the folded-back part of the bottom eyelash material
30—Lock thread
31—Warp filament
32—Weft filament
33—Needle
A—Folded-back part of the top eyelash material
B—Folded-back part of the bottom eyelash material
C—Ear part

DETAILED DESCRIPTION OF THE INVENTION

Each constitution used in the present invention is explained.

The eyelash material is a material constituting the hair part of the false eyelashes corresponding to an eyelash, while the axial thread is a filament to which multiple eyelash materials are fixed sequentially in a manner lining up in the length direction of the axial thread so that the eyelash materials extend vertically relative to the length direction of the axial thread and are placed in rows horizontally. And, the top eyelash material is an eyelash material fixed in a manner positioned above the axial thread when the axial thread is placed horizontally, while the bottom eyelash material is an eyelash fixed in a manner positioned below or on the opposite side, so that one of the top eyelash material and bottom eyelash material is positioned above and the other is positioned below. These top and bottom eyelash materials are fixed on the opposite sides of the axial thread on the flat faces including the length direction of the axial thread. Depending on how the false eyelashes are placed, the top eyelash material can be positioned below and the bottom eyelash material can be positioned above.

Preferably the eyelash materials are placed vertically relative to the length direction of the axial thread. Here, "vertically" does not have to mean exactly vertical; instead, it means an angle that allows the eyelash materials, when the false eyelash is used, to orient in the direction of real eyelashes.

The folded-back part of the top or bottom false eyelash refers, at a location where one eyelash material is fixed to the axial thread, to the folded-back part formed by folding the eyelash material.

The folded-back part adjacent to the axial thread refers to a condition after the folded-back part has been placed in contact with the axial thread, but before the ear part is formed, where the folded-back part is placed in contact with the axial thread to the extent that the folded-back part becomes one with the axial thread. If the folded-back part is not placed adjacent to the axial thread, it means the folded-back part is positioned away from the axial thread and therefore fixing it later relative to the axial thread becomes difficult.

Under the present invention, the knit structure refers to a structure where the loops forming the folded-back parts of the adjacent eyelash materials are fixed together as if knitted, or specifically by guiding one loop through the other loop, etc., and/or a structure where each loop is woven with another filament called the "lock thread."

The lock thread is a filament to join and connect the folded-back parts of the adjacent eyelash materials.

Also, the ear part is where the folded-back parts of multiple eyelash materials are fixed to the axial thread.

Additionally, if the axial thread is made of thermoplastic material at least partially, the axial thread and eyelash material can be fixed by means of thermal bonding. Thermal bonding is a means for heating and melting into one the axial thread and the top/bottom eyelash material and/or the axial thread and the folded-back part of the top/bottom eyelash material, as well as the lock thread if necessary, where these materials can be melted completely to the extent that no traces of knitting remain, or they can be melted partially just to allow for fixing, or specifically to heat and melt them into one, leaving the knit structure behind. Similarly, the traces of eyelash materials around the axial thread can be eliminated by heating and melting or they can be left behind.

Also, in addition to having the axial thread melt by heating, the top and bottom eyelash materials and lock thread can also be formed using materials that melt at this heating temperature.

If they are melted completely, the axial thread, top and bottom eyelash materials, and lock thread, if applicable, can be strongly fixed together, and if they are melted partially to the extent that they can be fixed, the surface irregularities due to knitting can be left on the surface of the ear part, which makes it easy to attach the false eyelash to the surface of the eyelid skin using adhesive.

Furthermore, when the axial thread is made of thermosetting material or other non-thermoplastic material at least partially, the axial thread and eyelash material can be fixed using a different means such as bonding with adhesive, etc., in place of the aforementioned thermal bonding means.

The false eyelashes pertaining to the present invention are explained using FIGS. 1 to 4.

FIRST EMBODIMENT

The first embodiment pertaining to the present invention is explained using FIG. 1. It should be noted, however, that, while the actual false eyelashes are fixed to the axial thread 10 and the top eyelash material 21 and bottom eyelash material 22 are also fixed rigidly to the axial thread 10, FIG. 1 shows a condition where the top eyelash material 21 and bottom eyelash material 22 have been intentionally loosened relative to the axial thread 10 for the purpose of clearly illustrating the relationships of these members.

The first embodiment of the false eyelashes pertaining to the present invention is, as shown in FIG. 1, false eyelashes 1 comprising top eyelash materials 21, bottom eyelash materials 22, and an axial thread 10 on which the top eyelash materials 21 and bottom eyelash materials 22 are placed, where the top eyelash materials 21 and bottom eyelash materials 22 consist of top eyelash materials 21 each having a folded-back part A and bottom eyelash materials 22 each having a folded-back part B, with the top eyelash materials 21 and bottom eyelash materials 22 placed alternately and adjacent to each other in a manner sandwiching the axial thread 10 from top and bottom, without looping around the axial thread. And, adjacent pairs of the folded-back part A and the folded-back part B each are fixed to the axial thread 10 by forming a knit structure, to form an ear part C. The ear part C is where the false eyelashes 1 proposed by the present invention contacts the eyelid when worn.

And, if the axial thread 10 is a fiber made of thermoplastic resin, for example, the top eyelash materials 21 and bottom eyelash materials 22 contacting the axial thread 10 become fixed to the axial thread 10 by means of thermal bonding. Here, the entire axial thread can be made of any thermoplastic resin that melts due to the heat used for thermal bonding, or it can also have a sheath made of such thermoplastic resin and a core made of thermosetting resin or any thermoplastic resin that does not melt due to the heat used for thermal bonding.

For the material of the axial thread 10, any polyester fiber made of polyethylene terephthalate, polytrimethylene terephthalate, polybutylene terephthalate, or the like, nylon or other polyamide fiber, polyvinyl chloride fiber, polyacrylonitrile fiber, polyolefin fiber made of polyethylene, polypropylene, or the like, polyvinyl chloride fiber, vinylon, acrylic fiber, silk, cotton, wool or other natural fiber, cellulose fiber made of rayon, viscose rayon, or the like, thermoplastic resin, resin other than thermoplastic resin, or natural resin, can be used, for example, and any of the foregoing can be selected as deemed appropriate in consideration of dyeing property, processing property, feeling against the skin, etc. The axial thread 10 can be constituted by one fiber or multiple fibers bundled together (multi-filaments) or multiple fibers stranded together.

If the axial thread 10 has a sheath-core structure comprising a sheath and a core, a sheath made of any thermoplastic resin mentioned above, and a core made of any thermoplastic resin having sufficiently high softening temperature or known thermosetting resin, can be adopted.

The thickness (diameter) of the axial thread 10 is preferably 50 μm to 300 μm, or more preferably 70 μm to 200 μm. If its thickness is within the aforementioned range, the axial thread 10 can easily be attached to the eyelid when worn. It should be noted that the thickness of the axial thread 10 is not limited to the aforementioned range.

Also, preferably the axial thread has a circular cross-section, but its cross-section can be oval.

For the fiber used for the top eyelash material 21 and bottom eyelash material 22, any one of various types can be selected as deemed appropriate so long as it has touch, texture, feel, and other properties similar to those of human eyelashes.

For example, any polyester fiber made of polyethylene terephthalate, polytrimethylene terephthalate, polybutylene terephthalate, or the like, nylon or other polyamide fiber, polyvinyl chloride fiber, polyacrylonitrile fiber, polyolefin fiber made of polyethylene, polypropylene, or the like, polyvinyl chloride fiber, vinylon, acrylic fiber, silk, cotton, wool or other natural fiber, cellulose fiber made of rayon, viscose rayon, or the like, thermoplastic resin, resin other than thermoplastic resin, or natural resin, can be used, and any of the foregoing can be selected as deemed appropriate in consideration of dyeing property, processing property, feeling against the skin, etc. The fiber constituting the top eyelash material 21 and bottom eyelash material 22 can be one fiber or multiple fibers bundled together (multi-filaments) or multiple fibers stranded together.

The thickness (diameter) of the top eyelash material 21 and bottom eyelash material 22 is preferably 40 μm to 150 μm, or more preferably 60 μm to 100 μm. If their thickness is within the aforementioned range, the top eyelash material 21 and bottom eyelash material 22 present touch, texture, feel, and other properties similar to those of human eyelashes. It should be noted that the thickness of the top eyelash material 21 and bottom eyelash materials 22 is not limited to the aforementioned range. Preferably the top eyelash material 21 and bottom eyelash material 22 have a circular cross-section, but their cross-section can be oval. If they have an oval cross-section, the top eyelash material 21 and bottom eyelash material 22 can be curled easily.

The axial thread 10, top eyelash material 21 and bottom eyelash material 22 can be black in color, or they can have brown, red or any other color.

In addition, preferably an antibacterial agent is blended into or applied onto at least one of the axial thread 10, top eyelash material 21 and bottom eyelash material 22. For the antibacterial agent, any organic antibacterial agent or inorganic antibacterial agent can be used as deemed appropriate.

The antibacterial agent can be applied onto the fiber surface of at least one of the axial thread 10, top eyelash material 21 and bottom eyelash material 22, or the antibacterial agent can be blended into any of the materials constituting the foregoing. The result is that bacterial growth and odor generation can be prevented at the surface of the false eyelashes.

Any known organic antibacterial agent can be used, but examples include paraoxy benzoate, paraoxy benzoate ester, benzoic acid, sodium benzoate, benzalkonium chloride, benzethonium chloride, chlorhexidine gluconate, or the like.

Also, any known inorganic antibacterial agent can be used, but examples include silver antibacterial agents, such as silver zeolite, silver glass, silver zirconium phosphate, or the like.

The application amount or blending amount of antibacterial agent can be adjusted as deemed appropriate to the extent that antibacterial action can be demonstrated.

For the material of the axial thread 10 and the material of the top eyelash material 21 and bottom eyelash material 22, various types of materials can be combined and the materials are not limited to specific combinations. Also, various types of materials can be used, like those mentioned above, for the false eyelashes explained in other embodiments besides this first embodiment.

(Structure of the False Eyelashes Representing the First Embodiment)

The materials specified below were adopted for use in the false eyelashes representing the first embodiment.

A core-sheath polyester fiber of outside fusion type was adopted for the axial thread, a regular polyester fiber (150 deniers, 48 filaments) thread was adopted for the warp, and a polyester fiber made of a mixture of polytrimethylene terephthalate resin (PTT resin) and polybutylene terephthalate resin (PBT resin) was adopted for the weft. The weft is the thread which becomes the false eyelashes. Also, the warp is the thread which is woven with the weft and then removed from the weft during the manufacturing process of the false eyelashes, thus not remaining in the false eyelashes as a product.

It should be noted that, as a mode common to the first embodiment and other embodiments, a thread colored in red, blue, etc., not black, brown or other natural color used for false eyelashes, can be adopted for the weft, and by changing the driving pitch of the weft or the type of weft depending on the false eyelashes, various types of false eyelashes can be manufactured, and even within the same unit of false eyelashes, the driving pitch of the weft or the type of weft can be changed depending on the location. The false eyelashes 1 representing the first embodiment has top eyelash materials 21 and bottom eyelash materials 22, as well as an axial thread 10 on which the top eyelash materials 21 and bottom eyelash materials 22 are placed.

The top eyelash materials 21 and bottom eyelash materials 22 consist of top eyelash materials 21 each having a folded-back part A and bottom eyelash materials 22 each having a folded-back part B.

The top eyelash materials 21 each having a folded-back part A and bottom eyelash materials 22 each having a folded-back part B are placed alternately and adjacent to each other in a manner sandwiching the axial thread 10. Here, the folded-back parts A, B are all positioned close to the axial thread and literally lying next to one another.

The top eyelash materials 21 and bottom eyelash materials 22 are such that the top eyelash materials 21 are placed above the axial thread 10, and the bottom eyelash materials 22 are placed below the axial thread 10. At this time, the top eyelash materials 21 and bottom eyelash materials 22 are not placed in a manner overlapping vertically; instead, they are placed in such a way that they come to the top side and bottom side alternately at specified intervals in the length direction of the axial thread 10.

The top eyelash materials 21 and bottom eyelash materials 22 are also placed in a manner extending to one end of the axial thread 10.

The folded-back parts A, B of the knit structure are fixed to the axial thread 10 by thermal bonding to form an ear part C. Also, the top eyelash materials 21 and bottom eyelash materials 22 are fixed in a manner contacting the axial thread 10.

This ear part C is where the false eyelashes 1, as formed, is worn on the eyelid. In this embodiment, the top eyelash materials 21 and bottom eyelash materials 22 are placed roughly evenly so that the false eyelashes 1, as formed, have a natural look. Furthermore, because the folded-back parts A, B of the knit structure are joined to the axial thread 10 and also because the top eyelash materials 21 and bottom eyelash materials 22 are fixed in a manner contacting the axial thread 10, excellent dimensional stability is achieved.

In general, fixing means include bonding using adhesive, etc., thermal bonding using heat, and the like, so any means appropriate for the materials used for the axial thread and eyelash materials can be selected and used. When using adhesive, etc., preferably an adhesive that does not make the bonded areas hard is used. If these areas become too hard, wearing the false eyelashes on the eyelid may become difficult.

If the fixing means by thermal bonding is adopted, a fiber, etc., having a core-sheath structure and made of thermoplastic resin can be used for the axial thread 10. In this case, the location that becomes the sheath is exposed to high temperature and melted, and the top eyelash materials 21 and bottom eyelash materials 22 contacting the sheath are fixed.

For the axial thread 10, a fiber, etc., having a core-sheath structure and made of a material other than thermoplastic resin can be used. In this case, the top eyelash materials 21 and bottom eyelash materials 22 contacting the sheath are fixed with adhesive, etc.

Specific examples of these fibers having a core-sheath structure include, for instance, polyester core-sheath fiber, polyamide core-sheath fiber, and fiber constituted by a long fiber covered with a fusing strand. The temperature needed to fix the eyelash materials using the fiber used, which has a core-sheath structure and is made of thermoplastic resin, can be adjusted as deemed appropriate. Use of a fiber having such structure prevents the fixed parts from becoming too hard and makes it easy to wear the false eyelashes 1.

It should be noted that these fibers having a core-sheath structure are only examples and fibers that can be used are not limited to the foregoing, and any material other than thermoplastic resin can be adopted, as mentioned above.

The false eyelashes 1 representing the first embodiment can have a size equivalent to any false eyelashes normally used. For example, the length of the part (ear structure) attached to the eyelid is 20 mm to 40 mm, while the lengths of the top eyelash material 21 and bottom eyelash material 22 are 3 mm to 30 mm.

With the false eyelashes 1 representing this embodiment, the top eyelash materials 21 and bottom eyelash materials 22 can be placed roughly evenly so that the false eyelashes 1, as formed, have a natural look. Additionally, because the folded-back parts A, B of the knit structure are fixed to the axial thread 10 and also because the top eyelash materials 21 and bottom eyelash materials 22 are fixed in a manner contacting the axial thread 10, excellent dimensional stability is achieved. Furthermore, use of a thermal bonding fiber to fix the eyelash materials creates a comfortable feeling when the false eyelashes are worn on the eyelid.

MANUFACTURING EXAMPLE 1

Next, Manufacturing Example 1 of the false eyelashes pertaining to the present invention is explained using FIG. 2.

The false eyelashes pertaining to the present invention can be made using a weaving machine having an axial thread 10 at least on both ends (only one end is shown in FIG. 2), multiple warps 31 and wefts 32 between the two axial threads, and needle 33, by folding back the wefts 32 at least over one axial thread 10.

The folded-back ends of the wefts 32 form loops and the loops are placed in a manner sandwiching the axial thread 10 alternately from top and bottom, where the weft 32 to be folded back next is hooked by the needle 33 that has been guided through the last formed loop and the weft 32 to be folded back next is pulled out from the loop with the needle 33, and similar operations are repeated to form knit structures.

This way, knit structures are formed by the adjacent folded-back parts. Folded-back parts are joined together in such a way that, into a loop 23 of the weft being the folded-back part of one top eyelash material above the axial thread 10, a loop 24 of the weft being the folded-back part of the next bottom eyelash material is inserted, and then into the loop 24 of the weft being the folded-back part of this bottom eyelash material, the loop 23 of the weft being the folded-back part of the next top eyelash material is inserted, and these operations are performed one by one to form the joints.

Next, manufacturing steps are performed in the following sequence: a step to connect the axial thread 10 and the knit structures, while fixing the axial thread 10 and the wefts 32 contacting the axial thread 10 by fusion, to form a weaving having an ear part; a step to cut the wefts 32 of the weaving along the lengthwise direction of the warps 31; a step to remove the warps 31 other than the fixed axial thread 10; and a step to cut the wefts 32 to an appropriate length to form false eyelashes.

Before the wefts 32 are cut to an appropriate length, the ends of the warps not on the axial thread 10 side are also forming loops. To make false eyelashes, the loops at these ends must be cut and the warps 31 must be removed. Or, one more axial thread 10 can be prepared and the above steps can be performed between two axial threads 10, thereby improving the production efficiency of false eyelashes.

The step to weave the warps 31 and wefts 32 and then remove the warps 31 to keep the wefts 32 only, and the step to cut the loops of the wefts 32 not on the axial thread 10 side, are required; however, either of these two steps can be performed first.

Notwithstanding the foregoing, preferably the step to remove the warps is performed after the step to cut the loops, in order to facilitate the step to cut the loops and step to adjust the eyelash length.

As mentioned above, the warps 31 are expected to be removed from the wefts 32, so the warps 31 can be made of a material that makes this removal easy. Such material has a sheet shape, filament shape, string shape, or plain weave shape, and its material can be paper, coated paper, fiber, resin, etc. As they are expected to be removed, the warps can be made slippery by applying lubricant or coating film on their surface.

Also, the ear part is where the manufactured false eyelashes contact the eyelid when worn. The wefts 32 become the eyelash materials of the manufactured false eyelashes.

For the weft, one monofilament or two or more monofilaments can be used. The greater the number of monofilaments, the higher the density of eyelash materials on the false eyelashes becomes.

Although the manufacturing method of the false eyelashes representing the first embodiment has been explained above as Manufacturing Example 1, the manufacturing method for the false eyelashes proposed by the present invention is described as follows.

First, the axial thread 10 is joined with the knit structures being the loops of the wefts 32 contacting the axial thread 10, to form a narrow weaving with an ear part.

For the means for connecting the axial thread 10 with the knit structures being the loops of the wefts 32 contacting the axial thread 10, any of the various methods mentioned above can be used. By connecting the axial thread 10 with the knit structures being the loops of the wefts 32 contacting the axial thread 10, and by also fixing the axial thread and the wefts contacting the axial thread, the wefts can be fixed in a manner arranged at even intervals, and the dimensional stability improves. The ear part thus formed is where the manufactured false eyelashes contact the eyelid when worn. The false eyelashes obtained by this manufacturing method offer good dimensional stability, so consequently it has a natural look and is easy to wear on the eyelid.

Next, the wefts of the narrow weaving are cut along the lengthwise direction of the warps.

For the cutting means, any means can be used as deemed appropriate. For example, methods such as cutting with a blade, cutting with a laser, etc., can be used. For the cutting location, any location can be selected by adjusting the distance from the ear part as deemed appropriate. One example is to cut at 20 mm or so away from the ear part. By cutting at a location some distance away from the ear part, the length of the eyelash materials can be adjusted. Also, preferably the wefts are cut to an appropriate length as the cut wefts will be polished and receive other processing.

The warps in the narrow weaving are removed from the cut location. Since the warps are not fixed, they can be removed easily. Finally, the ear part and the wefts leading from the ear part remain. It should be noted that the wefts do not come apart when cut, because the wefts are fixed to the axial thread. As explained earlier, the ear part is where the false eyelashes are worn on the eyelid, while the wefts leading from the ear part become the eyelash materials of the false eyelashes.

Next, the ear part is cut to an appropriate length to obtain false eyelashes of an appropriate length.

For the cutting means, any of the cutting means mentioned above can be used. It should be noted that the axial thread and wefts constituting the ear part do not come apart when the ear part is cut, because they are fixed.

(Structure of the False Eyelashes Representing Second Embodiment)

The materials specified below were adopted for use in the false eyelashes representing the second embodiment.

A core-sheath polyester fiber of outside fusion type was adopted for the axial thread, a regular polyester fiber (150 deniers, 48 filaments) thread was adopted for the warp, a polyester fiber made of a mixture of polytrimethylene terephthalate resin (PTT resin) and polybutylene terephthalate resin (PBT resin) was adopted for the weft, and a polyester fiber was adopted for the lock thread.

The second embodiment pertaining to the present invention is explained using FIG. 3.

The second embodiment pertaining to the present invention is the same as the first embodiment in the basic constitution and materials, but differs in the structure of the ear part; accordingly, this area of difference is explained.

To be specific, the second embodiment is characterized in that knit structures are formed by a lock thread that fixes adjacently placed folded-back parts together.

As shown in FIG. 3, the constitution is such that a lock thread 30 is guided through and connects the loops 23 of the wefts being the folded-back parts of the top eyelash materials as well as the loops 24 of the wefts being the folded-back parts of the bottom eyelash materials, where the lock thread 30 forms continuous loops and these loops in turn form knit structures that become parts of the ear part. Such constitution can be achieved using a needle weaving machine.

To be specific, as shown in FIG. 3, the lock thread 30 is advanced so that the first loop of the lock thread 30 is guided through the loop 23 of the weft being the folded-back part of the top eyelash material shown at the bottom of FIG. 3.

After the first loop of the lock thread 30 has been guided therethrough, the lock thread 30 is passed on the outside of the loop 23 of the weft being the folded-back part of this top eyelash material and guided from above into the loop of the lock thread 30 already formed, after which the lock thread 30 is passed from below the loop 24 of the weft being the folded-back part of the bottom eyelash material right next to it and passed again, as if to form a second loop of the lock thread 30, below the loop 24 of the weft being the folded-back part of the bottom eyelash material and above the first loop of the lock thread 30, thereby completing the second loop of the lock thread 30.

Again, the lock thread 30 is guided from above the second loop of the lock thread 30, after which the lock thread 30 is passed from below the loop 23 of the weft being the folded-back part of the next top eyelash material, to form a third loop of the lock thread 30.

Furthermore, the lock thread 30 is passed below the loop 23 of the weft being the folded-back part of the top eyelash material and then returned from above the second loop of the lock thread 30, to complete the third loop of the lock thread 30.

By guiding the lock thread 30 this way, knit structures are formed by the lock thread 30 and the eyelash materials are fixed to the axial thread 10.

By fixing the eyelash materials to the axial thread this way, the top and bottom eyelash materials do not form knit structures together and therefore no force is applied directly which tries to bend the top and bottom eyelash materials relative to the axial thread. As a result, the top and bottom eyelash materials can be extended in a planned direction relative to the axial thread.

The aforementioned placement and fixing achieves constant intervals between the eyelash materials and improves the dimensional stability, and the eyelash materials look natural because there are no longer sparse areas and dense areas between them. Also, the eyelash materials, being connected by the lock thread, are fixed more strongly, which prevents the eyelash materials from falling out easily and creates a natural look.

(Structure of the False Eyelashes Representing Third Embodiment)

The materials specified below were adopted for use in the false eyelashes representing the third embodiment.

A core-sheath polyester fiber of outside fusion type was adopted for the axial thread, a regular polyester fiber (150 deniers, 48 filaments) thread was adopted for the warp, a polyester fiber made of a mixture of polytrimethylene terephthalate resin (PTT resin) and polybutylene terephthalate resin (PBT resin) was adopted for the weft, and a polyester fiber was adopted for the lock thread.

Next, the third embodiment pertaining to the present invention is explained using FIG. 4.

The third embodiment pertaining to the present invention is the same as the first embodiment and second embodiment in the basic constitution and materials, but differs in the structure of the ear part; accordingly, this area of difference is explained.

To be specific, the third embodiment is characterized in that knit structures are formed by adjacently placed folded-back parts themselves, and a lock thread that fixes the folded-back parts.

As shown in FIG. 4, the folded-back parts of the top eyelash materials and the folded-back parts of the bottom eyelash materials, which are placed adjacent to each other, form knit structures, while the lock thread fixing the folded-back parts also forms knit structures, to constitute an ear part.

To be specific, by using a narrow weaving machine which has an axial thread at least on both ends, multiple warps and wefts between the two axial threads, and needle, false eyelashes are manufactured by: a step wherein the wefts are folded back at least over one axial thread, where the folded-back ends of the wefts form loops and the loops are placed in a manner sandwiching the axial thread alternately from top and bottom, and the weft to be folded back next and the lock thread are hooked by the needle that has been guided through the last formed U-shaped loop and the weft to be folded back next and the lock thread are pulled out from the loop with the needle, and similar operations are repeated to form knit structures; a step to fix the axial thread with the wefts contacting the axial thread and the knit structures to form a narrow weaving having an ear part; a step to cut the wefts of the narrow weaving along the lengthwise direction; a step to remove the warps other than the fixed axial thread; and a step to cut the ear structure to an appropriate length to form false eyelashes.

Folded-back parts are joined together in such a way that, into the loop 23 of the weft being the folded-back part of one top eyelash material above the axial thread, the loop 24 of the weft being the folded-back part of the next bottom eyelash material is inserted, and then into the loop 24 of the weft being the folded-back part of this bottom eyelash material, the loop 23 of the weft being the folded-back part of the next top eyelash material is inserted, and these operations are performed one by one to form the joints. Furthermore, the loops are connected together by the lock thread. This way, the ends of the eyelash materials contacting the axial thread are connected further by the lock thread guided through the knit structures. By forming the ear part with the knit structures this way, the eyelash materials can be connected more strongly together.

As they are connected this way by further using the lock thread through the knit structures, the eyelash materials maintain almost even intervals and their dimensional stability improves. Also, the eyelash materials look natural because there are no longer sparse areas and dense areas between them. In addition, the eyelash materials, being connected by the lock thread, are fixed more strongly, which prevents the eyelash materials from falling out easily and creates a natural look.

(Structure of the False Eyelashes Representing Fourth Embodiment)

The materials specified below were adopted for use in the false eyelashes representing the fourth embodiment.

A silk thread was adopted for the axial thread, a regular polyester fiber (150 deniers, 48 filaments) thread was adopted for the warp, a polyester fiber made of a mixture of polytrimethylene terephthalate resin (PTT resin) and polybutylene terephthalate resin (PBT resin) was adopted for the weft, and a polyester fiber was adopted for the lock thread, if used, although use of the lock thread is not required.

Also, a chloroprene adhesive was adopted for the adhesive.

The fourth embodiment pertaining to the present invention is the same as the first embodiment in the weaving structure, but differs in that the fiber used as the axial thread is a silk thread and not thermoplastic resin.

Accordingly, the axial thread and wefts were fixed not by means of fusion, but by means of bonding using adhesive prepared separately.

As explained in the first embodiment through the fourth embodiment, the false eyelashes pertaining to the present invention use knit structures to achieve constant intervals between the eyelash materials, and because the ear part formed by these structures, false eyelashes can be provided which have excellent dimensional stability as false eyelashes, superior comfort when worn on the eyelid, and a natural look.

What is claimed is:

1. False eyelashes containing an axial thread and eyelash members placed on the axial thread and extending from the axial thread in an extending direction roughly orthogonal to the axial thread, wherein:

the eyelash members comprise multiple top eyelash members positioned on top of the axial thread, as well as multiple bottom eyelash members positioned under the axial thread, as viewed in a longitudinal direction orthogonal to a top-bottom direction when the false eyelashes are placed longitudinally on a horizontal plane;

each top eyelash member has a fold-back structure where each top eyelash member is folded at the axial thread on top of the axial thread without looping around the axial thread, and each bottom eyelash member has a fold-back structure where each bottom eyelash member is folded at the axial thread without looping around the axial thread, as viewed in the longitudinal direction, wherein a folded-back part of each fold-back structure is placed adjacent to the axial thread;

the multiple top eyelash members and the multiple bottom eyelash members, each having the folded-back part, are placed and fixed in rows alternately on top of or under, respectively and along the axial thread in a length direction of the axial thread from one end to another end of the axial thread, wherein each folded-back part lies down on top of or under, respectively, the axial thread and extends along the axial thread in the length direction of the axial thread which is orthogonal to the extending direction of the eyelash members;

the folded-back parts of the top eyelash members and the bottom eyelash members are fixed together and have a knit structure formed by the folded-back parts of adjacent top and bottom eyelash members, wherein the knit structure is a structure where loops forming the folded-back parts of adjacent top and bottom eyelash members are fixed together wherein one of said loops is guided through another of said loops; and the fixed folded-back parts, which are fixed to the axial thread, constitute an ear part where the false eyelashes are to contact the eyelid when in use.

2. False eyelashes according to claim 1, characterized in that the axial thread, the top eyelash members, and the bottom eyelash members are made of a material selected from polyester fibers, polyamide fibers, polyolefin fibers, polyvinyl chloride fibers, natural fibers, and cellulose fibers.

3. False eyelashes according to claim 1, wherein an antibacterial agent is blended into or applied onto any of the axial thread, the top eyelash members, and the bottom eyelash members.

4. False eyelashes according to claim 1, wherein the axial thread is at least partially made of thermoplastic resin.

5. False eyelashes according to claim 2, wherein an antibacterial agent is blended into or applied onto any of the axial thread, the top eyelash members, and the bottom eyelash members.

6. False eyelashes according to claim 2, wherein the axial thread is at least partially made of thermoplastic resin.

7. False eyelashes according to claim 3, wherein the axial thread is at least partially made of thermoplastic resin.

* * * * *